US006733197B2

(12) United States Patent
Koike et al.

(10) Patent No.: US 6,733,197 B2
(45) Date of Patent: May 11, 2004

(54) IMAGE RECORDING APPARATUS

(75) Inventors: Mitsuru Koike, Minami-Ashigara (JP); Yoshio Ishii, Minami-Ashigara (JP); Makoto Yamada, Minami-Ashigara (JP); Eiichi Kito, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 35 days.

(21) Appl. No.: 10/139,233

(22) Filed: May 7, 2002

(65) Prior Publication Data

US 2002/0192003 A1 Dec. 19, 2002

(30) Foreign Application Priority Data

May 7, 2001 (JP) ..... 2001-136150

(51) Int. Cl.[7] ..... B41J 11/68; B41J 11/70

(52) U.S. Cl. ..... 400/621.1; 400/621; 400/635; 347/102; 347/104

(58) Field of Search ..... 400/621, 621.1, 400/578, 611, 613, 635; 347/102, 104

(56) References Cited

U.S. PATENT DOCUMENTS 4,784,318 A * 11/1988 Bay ..... 234/2
5,360,161 A * 11/1994 Schaller et al. ..... 234/42
6,394,669 B1 * 5/2002 Janosky et al. ..... 396/571
6,428,157 B1 * 8/2002 Wen ..... 347/101
6,554,511 B2 * 4/2003 Kwasny et al. ..... 400/621
6,561,639 B1 * 5/2003 Shimoda et al. ..... 347/101
2003/0085947 A1 * 5/2003 Suzuki et al. ..... 347/41

FOREIGN PATENT DOCUMENTS

JP 2000-127550 5/2000

* cited by examiner

*Primary Examiner*—Daniel J. Colilla
(74) *Attorney, Agent, or Firm*—Young & Thompson

(57) ABSTRACT

An image recording apparatus records an image by adhering ink droplets ejected from a recording head to a long recording material. A solvent in the ink droplets is removed by a heating and drying section, and a transparent sheet material is laminated onto an image recording surface of the recording material by a laminating section. Subsequently, the recording material is cut into pieces by a first cutter along boundaries of recorded images, which boundaries extend in a transverse direction of the recording material. A piece having images recorded thereon is transferred to a conveyance belt, conveyed, cut for each of the images by a second cutter, and accumulated in a print accumulating section via a conveyance belt. A piece having a single image recorded thereon is conveyed on another conveyance belt and accumulated in the print accumulating section. Thus, processing time per image can be reduced.

14 Claims, 6 Drawing Sheets

AT THE TIME OF NON-CUTTING

AT THE TIME OF CUTTING

IMAGE RECORDING APPARATUS

BACKGROUND OF THE INVENTION

1. Field of the Invention

The present invention relates to an image recording apparatus, and particularly to an image recording apparatus, which records a plurality of images on an elongated recording material by adhering thereto ink droplets for recording ejected from ejection orifices of a recording head, and cuts the recording material into units of recorded areas corresponding to the respective images.

2. Description of the Related Art

The most common method for recording a color image of a photographed object on a recording material, such as recording paper, uses a silver halide color photosensitive material. While this method has an advantage in that a large amount of images can be recorded at high speed, the method also has a drawback in that an apparatus is large and has a complicated structure, resulting in complex maintenance. Although various improvements have been devised to obtain an apparatus which is small and needs little maintenance, further improvements on the apparatus are demanded.

An ink jet recording method, in which an image is recorded on a recording material by ejecting ink droplets from ejection orifices of a recording head and adhering them onto the recording material, is known as another image recording method. The ink jet recording method is widely used in applications such as recording data, which has been outputted from a computer, on a recording material as an image. Since an image is recorded by directly adhering a pigment solution (i.e., ink) to the recording material, the ink jet recording method has an advantage in that variations in the density of an image due to changes in environmental conditions, such as temperature, are small. Further, the ink jet recording method is basically advantageous in maintenance in comparison to the image recording method using the silver halide color photosensitive material.

An example of an apparatus for recording an image at high speed in accordance with the ink jet recording method is disclosed in Japanese Patent Application Laid-Open (JP-A) No. 2000-127550. An end of a roll of wide recording material is pulled out and conveyed in a first direction which is parallel to a direction in which the recording material is pulled out. Images are recorded in parallel with each other on the recording material along a transverse direction thereof. Thereafter, a portion of the recording material on which the images have been recorded is separated (cut) from a portion of the recording material on which no images are recorded, conveyed in a second direction orthogonal to the first direction (i.e., a direction parallel to the direction in which the images are arranged), and cut into the respective images.

However, in the above-described image recording apparatus, after the portion of the recording material, on which the images have been recorded in parallel with each other in the transverse direction, is separated, the separated portion is sequentially cut into the respective images while being conveyed frame by frame. Therefore, the apparatus has a drawback in that a processing time required for each image (i.e., a time required to record images onto the recording material, cut the recording material into the respective images, and output the cut recording materials) is long.

Further, the ink jet recording method may have malfunctions, such as improper ejection of ink droplets resulting from blockage of the ejection orifices of the recording head. When malfunctions occur, fatal flaws, which are easily observable, such as white streaks in an image, are formed. This drawback becomes particularly problematic when a large number of images are sequentially recorded on the recording material. When the above-mentioned defect is observed after sequential recording of a large number of images is completed, all the images need to be re-recorded, which leads to a substantial decrease in processing capacity (i.e., the number of images recorded per unit time) and the yield of output images having appropriate image quality. However, the above disclosure does not mention this drawback.

SUMMARY OF THE INVENTION

In view of the aforementioned facts, an object of the present invention is to obtain an image recording apparatus which can shorten a processing time required for each image.

In order to achieve the above object, the present invention relates to an image recording apparatus for recording images represented by image data on an elongated recording material using ink, the image recording apparatus comprising: recording means which includes a recording head, that has at least one ejection orifice and ejects ink droplets for recording from the ejection orifice so that the ink droplets adhere to the recording material, the recording means being able to record a plurality of images in parallel with each other along a transverse direction of the recording material; first cutting means which cuts the recording material, after images have been recorded thereon, into pieces along boundaries of the recorded images, the boundaries extending in the transverse direction of the recording material; conveyance means for conveying the pieces of the recording material, which pieces have been cut by the first cutting means, in a direction substantially orthogonal to a direction in which the pieces have been cut by the first cutting means; second cutting means for cutting the pieces of the recording material, which pieces have been conveyed by the conveyance means, along boundaries of the recorded images, the boundaries extending in the direction in which the pieces are conveyed; and control means for controlling the second cutting means so that the second cutting means cuts the pieces, each having a plurality of images recorded thereon, along the boundaries of the respective recorded images, the boundaries extending in the direction in which the pieces are conveyed.

The recording means can record images in parallel with each other along the transverse direction of the recording material by adhering ink droplets, which have been ejected from the ejection orifice of the recording head, to the elongated recording material. The recording means may record the images with a fixed size in a fixed recording format (i.e., a format in which the images are recorded in the transverse direction of the recording material), or in a recording format corresponding to the size of the images to be recorded, which format is selected from multiple recording formats which have been prepared to record images of multiple sizes. The multiple recording formats may include a recording format, in which a single image is recorded along the transverse direction of the recording material.

As a scanning method (image recording method) which is carried out by the recording head, one of the following methods may be used: a method in which an image is recorded on the recording material by moving the recording head in two directions intersecting each other while the recording material is conveyed in a fixed direction; and a method in which, while the recording material is conveyed in a fixed direction, an image is recorded on the recording material with a recording head that has a large number of ejection orifices successively arranged from one end of the recording material to the other, in a direction intersecting the direction in which the recording material is conveyed.

The recording material, on which images have been recorded by the recording means, is cut into pieces along boundaries of the recorded images, which boundaries extend in the transverse direction of the recording material. The pieces of the recording material are conveyed in a direction substantially orthogonal to the direction in which the pieces are cut by the first cutting means. As described above, by cutting the recording material into pieces with the first cutting means, the conveyance means can convey the pieces of the recording material, which have been cut by the first cutting means, downstream from a position at which the recording material is cut by the first cutting means, at high speed without being affected by the speed at which images are recorded by the recording means.

The second cutting means is disposed in the image recording apparatus and can cut, along the direction in which the pieces are conveyed (hereinafter, referred to as simply a conveyance direction), the pieces of the recording material, which are conveyed by the conveyance means. The control means controls the second cutting means such that the second cutting means cuts, from among the pieces of the recording material conveyed by the conveyance means, the piece of the recording material that has a plurality of the images recorded thereon, along boundaries of the respective recorded images, which boundaries extend in the conveyance direction. The second cutting means cuts the pieces along the conveyance direction. Therefore, when the plurality of the images is recorded along the transverse direction of the recording material, the recording material does not need to be intermittently conveyed, and can be cut for each image while being conveyed. According to the aspect of the present invention, the processing time for a single image can be reduced.

The image recording apparatus of the present invention may record images of a fixed size in a fixed recording format. However, when images can be recorded in multiple recording formats having different boundaries for the respective images, which boundaries extend in the conveyance direction, it is preferable that the second cutting means includes a cutter, which is disposed at each position that corresponds to one of the boundaries of the recorded images in the multiple recording formats and can select whether or not to cut the pieces of the recording material and that the control means determines the recording format for each of the pieces and select whether or not the recording material is to be cut by the respective cutters of the second cutting means.

Since one of the cutters is disposed at each position corresponding to the boundaries for each of the recorded images in the multiple recording formats, it is not necessary to perform a process which is complicated and requires high accuracy, such as moving the cutters to the positions corresponding to the boundaries for each of the recorded images, in accordance with the recording format for each of the pieces. Therefore, the apparatus can have a simple structure even if it can record images in the multiple recording formats.

A cutter having a disc-shaped member rotatably supported by a shaft, and a blade formed on the periphery of the member can be used. The cutter can be formed so as to be movable between a first position, at which the blade is pressed against the recording material and rotated along with the conveyance of the recording material, and a second position, at which the blade is spaced from the recording material. In this case, when the cutter is at the first position, by the cutter being rotated along with the conveyance of the recording material, the recording material is cut along the conveyance direction. When the cutter is at the second position, cutting of the recording material is stopped.

Accordingly, whether or not the recording material is to be cut by the respective cutters of the second cutting means can be selected by positioning each of the cutters at the first or second position. Therefore, the structure of the apparatus can further be simplified even if it can record images in the multiple recording formats.

When images can be recorded in both a first recording format for recording a plurality of images along the transverse direction of the recording material and a second recording format for recording a single image along the transverse direction of the recording material, the present invention may comprise a first conveyance path, at which the second cutting means is disposed, and a second conveyance path, at which no second cutting means is disposed, to convey the pieces of the recording material. In this case, the control means can control the conveyance paths such that the piece of the recording material having the plurality of images recorded thereon is conveyed along the first conveyance path, and the piece of the recording material having the single image recorded thereon is conveyed along the second conveyance path.

By the pieces of the recording material, each of which has images recorded thereon in accordance with the second recording format, being conveyed along the second conveyance path, the recording format for the pieces of the recording material to be conveyed along the first conveyance path becomes fixed when only a single recording format is used as the first recording format. Further, the cutting position for the pieces of the recording material does not need to be changed in accordance with the recording format.

The image recording apparatus of the present invention may further include accumulating means for sorting and accumulating the recording material, which has been cut for each of the recorded images, based on each case (e.g., based on the recording material whose images recorded thereon correspond to original images recorded on the same recording material such as a photographic film, or based on the recording material whose images recorded thereon correspond to a single order). With this accumulating means, an operator does not need to sort or accumulate, for each photographic film or each order, the recording material that has been cut for each of the images recorded thereon. Therefore, work of the operator can be reduced.

Further, the image recording apparatus of the present invention may include means for forming a transparent film on the image recording surface of the recording material, on which surface an image has been recorded by the recording means. As a result, water resistance and weather resistance of the image which has been recorded on the recording material can be improved.

There are several methods for forming a transparent film. For example, a transparent film can be formed by attaching a transparent polymer film to the image recording surface. The transparent film can be formed stably and relatively inexpensively by using this method.

If a solvent, which is included in ink droplets adhering to the recording material, remains in the recording material during formation of a transparent film on the image recording surface of the recording material, the solvent is trapped in the transparent film and may deteriorate the image quality of recorded images. Therefore, the image recording apparatus of the present invention preferably includes heating means, which applies heat to the recording material on which images have been recorded, thereby removing the solvent included in the ink droplets adhering to the recording material. Thus, the solvent included in the ink droplets adhered to the recording material can be removed in a short time, and this deterioration of the image quality of the recording material can be prevented.

Removal of the solvent by the heating means, and formation of the transparent film by the film forming means are preferably carried out after the recording means has recorded the image on the recording material and before the first cutting means cuts the recording material.

Further, the image recording apparatus of the present invention includes supply means for supplying the recording material. The recording material may be shaped into a roll, and the recording means may record images onto the recording material which has been pulled out and conveyed to a recording position. In this way, handling characteristics of the recording material during loading thereof in the image recording apparatus is improved, as compared with a case in which the recording material is cut into pieces of predetermined sizes in advance.

The image recording apparatus of the present invention may further include monitoring means for monitoring whether an event, which interferes with image recording carried out by the recording means, has occurred during image recording, and processing means which, when the monitoring means determines that the event has occurred, carries out a processing for removing the event or the defect caused by the event.

Examples of the event that interferes with image recording include malfunction of the recording means (specifically, blockage in an ejection orifice of the recording head, a decrease in the amount of ink ejected from the recording head, or other events), and a decrease in the capacity of storage means, which stores information on images. Further, the image recording apparatus may include acquiring means for acquiring information on an original image to be recorded on the recording material, and image processing means, which carries out image processing with respect to the information on the original image acquired by the acquiring means, to thereby generate information representing an image to be recorded on the recording material, and outputs the generated information to the recording means. Examples of the event that interfere with image recording in the image recording apparatus that includes the acquiring means and the image processing means, include malfunction of the acquiring means, acquirement of defective information on the original image by the acquiring means, and inappropriate image processing carried out by the image processing means.

Even when the above-described events occur while the recording means successively records a plurality of images on the recording material, the events are detected by the monitoring means, and defects in image recording or the events themselves which cause the defects are eliminated. Therefore, recording a large number of inappropriate images after occurrence of the events, or image recording being stopped for a long time due to the events can be prevented. Further, the processing capacity of the image recording apparatus of the present invention and the yield of appropriate images can be increased.

DESCRIPTION OF THE PREFERRED EMBODIMENT

Figure 1:
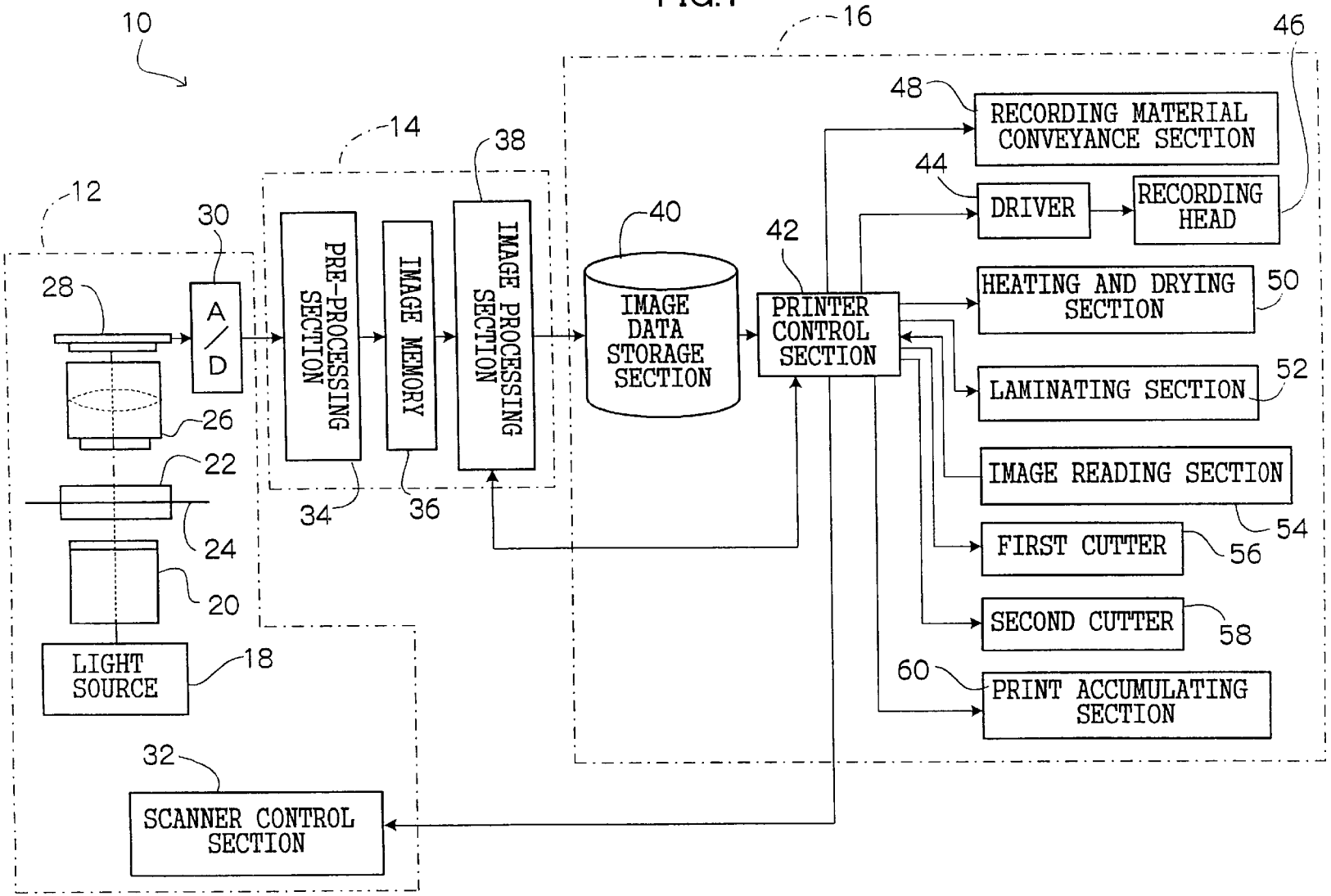
FIG. 1 is a block diagram that schematically shows the structure of an image recording system relating to the present invention.

Hereinafter, an embodiment of the present invention will be described in detail with reference to the drawings. FIG. 1 schematically shows the structure of an image recording system 10, to which the present invention is applied. The image recording system 10 includes a film scanner 12 serving as an input device for inputting image data, an image processing device 14 for processing the image data inputted from the film scanner 12, and an ink jet printer 16, which records images in accordance with the inkjet recording method. The ink jet printer serves as an output device for outputting an image represented by the image data, which has been processed by the image processing device 14.

The film scanner 12 reads a film image (a negative image or a positive image, which is made visible by development after photographing of an object) recorded on a photographic photosensitive material (hereinafter referred to simply as "photographic film") such as a photographic film 24 (such as a negative film or a reversal film). The film scanner 12 then outputs image data obtained by the reading. Light, which is emitted from an LED light source 18 and whose unevenness in the amount thereof has been reduced by a light diffusion box 20, is irradiated onto the photographic film 24, which is set at a film carrier 22. The light transmitted through the photographic film 24 is focused via a lens 26 onto a light-receiving surface of an area CCD sensor 28 (or a linear CCD sensor).

The film carrier 22 intermittently conveys the photographic film 24 so that the film images are successively positioned on the optical axis of the light emitted from the LED light source 18 (i.e., at a reading position). The LED light source 18 is formed by LEDs for emitting red (R) light, LEDs for emitting green (G) light, LEDs for emitting blue (B) light, and LEDs for emitting infrared (IR) light, which LEDs are arranged over the entire surface of an unillustrated substrate in a fixed order and at high density. When an image is at the reading position, the LED light source 18 is driven by a driver, not shown, so as to sequentially emit light of R, G, and B.

Film images recorded on the photographic film 24 are sequentially read by the CCD sensor 28, and the CCD sensor 28 outputs signals of light of R, G, B, and IR, which signals correspond to the film images. The signals outputted from the CCD sensor 28 are converted into digital image data by an A/D converter 30, and are inputted to the image processing device 14. A scanner control section 32 is disposed inside the film scanner 12 and controls the operation of respective sections of the film scanner 12. The film scanner 12 may read the respective film images multiple times. For example, the film scanner 12 may read the film images at a relatively low resolution (pre-scanning) and read the film images again at a relatively high resolution (fine scanning).

As the input device of the present embodiment, a reflection scanner may be disposed separately from the above-described film scanner 12. The reflection scanner reads an image by photoelectrically transferring light reflected from an original (for example, color paper having an image recorded thereon) and outputs image data obtained by the reading. The reflection scanner preferably includes a mechanism for automatically supplying originals sequentially to a reading section of the scanner such that the originals can be automatically and sequentially read.

The film scanner 12 is connected to a pre-processing section 34 of the image processing device 14. The pre-processing section 34 carries out predetermined pre-processing such as darkness correction, density conversion, shading correction, defective pixel correction, and the like, for the image data inputted from the film scanner 12. The pre-processing section 34 is connected via an image memory 36 to an image processing section 38. The image data which has been subjected to the pre-processing in the pre-processing section 34 is temporarily stored in the image memory 36, and read by and inputted to the image processing section 38. The image processing section 38 computes and automatically determines conditions for processing various types of images, based on the image data, which has been read from the image memory 36. This computation is called "setup computation".

Examples of image processings carried out by the image processing section 38 include processings for improving the quality of output images, such as gray balance adjustment, density adjustment, and gradation control of an image, hyper-tone processing for compressing the gradation of super-low frequency brightness components of an image, hypersharpness processing for enhancing the sharpness while suppressing grainness, and a processing for correcting, based on IR data, defects of the image data caused by scratches on the photographic film or by foreign matter adhering to the photographic film.

Further, the image processing section 38 subjects the image data, which has been read from the image memory 36, to various types of image processings in accordance with the processing conditions determined by the setup computation. The image processing section 38 is connected to an image data storage section 40 of the ink jet printer 16. The image data, which has been subjected to the various types of image processings, is transferred to the image data storage section 40 as image data for recording, and is temporarily stored therein.

Every time reading of the respective film images recorded on the photographic film 24 is completed, the film scanner 12 outputs a signal representing the completion of the reading. Based on the signal, the image processing device 14 recognizes image data corresponding to the photographic film 24 and stores the image data in the image data storage section 40 so that the image data corresponding to the photographic film 24 can be easily identified. The identifiable storage of the image data can be achieved by naming a file of the image data to be stored in the image data storage section 40 with a code system in which the photographic film from which the image data is read can be identified, or by separately storing the respective image data in folders corresponding to the respective photographic films.

The image data storage section 40 of the ink jet printer 16 is connected to a printer control section 42. The printer control section 42 is connected to the scanner control section 32 of the film scanner 12, and to the image processing section 38 of the image processing device 14. Further, although details will be described later, a recording head 46 is disposed in the ink jet printer 16 and connected via a driver 44 to the printer control section 42. Moreover, the printer control section 42 is connected to a recording material conveyance section 48, a heating and drying section 50, a laminating section 52, an image reading section 54, a first cutter 56, and a second cutter 58.

The recording head 46 and the driver 44 can correspond to the recording means of the present invention. Further, the recording material conveyance section 48 can correspond to the conveyance means of the present invention. The recording material conveyance section 48 includes a motor for intermittent conveyance, conveyance roller pairs 82 and 84, a deceleration mechanism which connects the motor for intermittent conveyance to the conveyance roller pairs 82 and 84, a belt driving motor, conveyance belts 86, 88, 90, 98, and 100, and a deceleration mechanism which connects the belt driving motor to the conveyance belts 86, 88, 90, 98, and 100. These components will be described later.

Moreover, the first cutter 56 and the second cutter 58 can correspond to the first cutting means and the second cutting means of the present invention, respectively. The printer control section 42 serves as the control means of the present invention. The heating and drying section 50 can correspond to the heating means, while the laminating section 52 can correspond to the film forming means.

Figure 2:
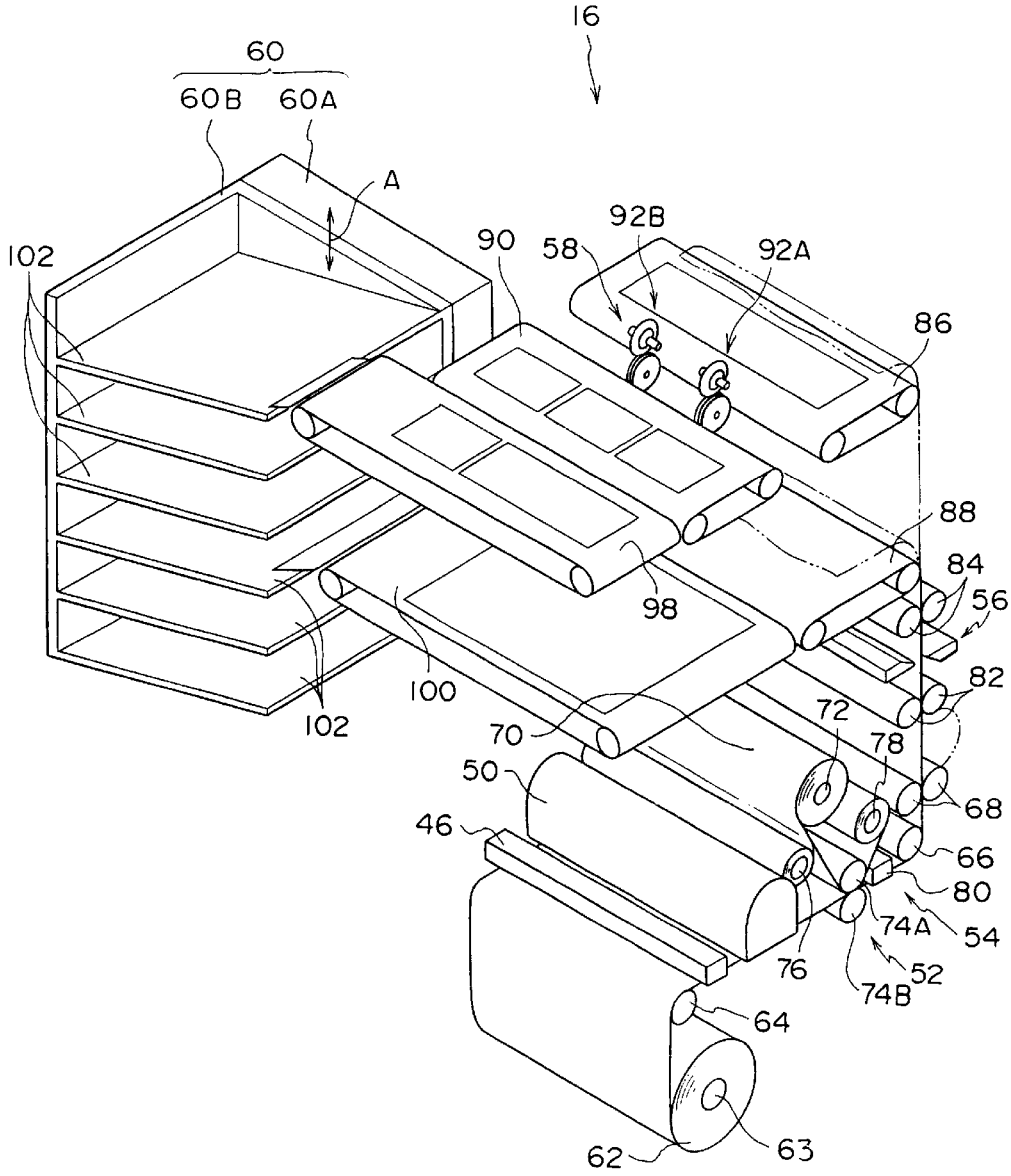
FIG. 2 is a schematic structural diagram of an ink jet printer.

As shown in FIG. 2, a recording material 62 is set near a lower end of an unillustrated casing for the ink jet printer 16, and accommodated in an unillustrated magazine. The recording material 62 is long and shipped in the shape of a roll having a core 63, with a surface on which an ink-receiving layer is formed (i.e., image recording surface) facing out. When used for image recording, the recording material 62 is loaded in the magazine, and the magazine is set in the casing at a predetermined position, shown in FIG. 2.

In the present embodiment, as will be described later, the recording material 62 used is wide such that small images (e.g., 127 mm×178 mm) can be recorded along a transverse direction of the recording material 62 or a large image (e.g., panorama-size) can be recorded on the recording material 62.

The recording material 62 used in the present embodiment is as follows. A transparent or opaque base material can be used as a support for the recording material 62. Examples of the support include paper such as quality paper, art paper, resin-coated paper, and baryta paper, and films of polyethylene phthalate, triacetate, polycarbonate, polyacrylate, and copolymers thereof. A support used by a silver salt color photosensitive material is particularly advantageous. It is also possible to use ink-absorbing paper or a porous resin film, which has been coated with a thermoplastic resin and then subjected to a post-processing so that resistance to water and air is improved. In order to obtain a recording material of quality as good as that of the silver salt color photosensitive material, it is advantageous to use a support having high whiteness, high smoothness, and high storability, such as the baryta paper or white paper. The smoothness is preferably 20 or more seconds in Bekk surface smoothness in accordance with a method described in JIS-P8119, and 2 to 30 kg of tensile strength in accordance with a method described in JIS-P-8113.

The ink-receiving layer is a layer which absorbs ink ejected from the ink jet printer with little bleeding of the ink, adsorbs and fixes a dye, and thereby holds an image. In order to improve water-absorption, adsorption and fixation of the dye for image formation on a particular layer, and to obtain an image having little bleeding or beading of the ink, an ink-receiving layer having multiple sub-layers is advantageously formed by disposing a water-absorbing sub-layer near the support and disposing multiple sub-layers for adsorbing and fixing the dye. Main components used are: an inorganic pigment, which adsorbs the dye; and a surfactant serving as a binder, which has high ink permeability and does not inhibit adsorption of the dye. Further, a thermoplastic resin latex is preferably used to protect an image. The ink-receiving layer is porous so as to maintain ink permeability.

Known inorganic pigments such as silica, calcium carbonate, calcium sulfate, diatomaceous earth, calcium silicate, colloidal silica, alumina, pseudo-boehmite, colloidal alumina, and alumina hydrate are used as inorganic pigments which adsorb a dye. Alumina hydrate, silica, and colloidal silica are particularly preferable, since they have gaps in layers thereof.

Alumina hydrate can be produced using known processes such as hydrolysis of aluminum alkoxide, hydrolysis of sodium aluminate, and the like. Alumina hydrate may have a shape of cilia, needles, plates, or spindles. The shape of alumina hydrate is not limited to a particular shape, and orientation thereof is not required.

Alumina hydrate used in the present invention may be selected from commercially available alumina hydrates or made from raw materials thereof. These alumina hydrates have characteristics of high transparency, high glossiness, and high dye fixation. In addition to these characteristics, it is advantageous if the alumina hydrates exhibit excellent coating and do not form cracks during film formation. Examples of the commercially available alumina hydrates include AS-2 and AS-3 produced by Catalysts & Chemicals Ind. Co., Ltd., and 520 produced by Nissan Chemical Industries, Ltd.

Since these alumina hydrates usually have a small particle diameter, such as 1 $\mu$m or less, and have excellent dispersibility, the recording material 62 containing alumina hydrate can have very good smoothness and glossiness.

The amount of an inorganic pigment, particularly alumina hydrate, coated onto the base material is preferably 10 g/m$^2$ or more in order to fix the dye. When the base material does not absorb ink, the coating amount is preferably 30 to 50 g/m$^2$. When the base material absorbs ink, the coating amount is preferably 20 to 40 g/m$^2$.

Although coating and drying methods are not particularly limited, alumina hydrate and a binder may be calcined if necessary. Calcination of alumina hydrate and a binder increases crosslinking strength of the binder, mechanical strength of the ink-receiving layer, and glossiness of a surface of alumina hydrate.

The binder for binding an inorganic pigment can be freely selected from water-soluble polymers. Examples of water-soluble polymers include polyvinyl alcohols or denatured formulations thereof, starch or denatured formulations thereof, gelatins or denatured formulations thereof, caseins or denatured formations thereof, arabic gums, cellulose derivatives such as carboxymethyl celluloses, hydroxyethyl celluloses, and hydroxypropylmethyl celluloses, conjugate diene copolymer latexes such as SBR latexes, NBR latexes, and methyl metacrylate-butadiene copolymers, functional group-modified polymer latexes, vinyl copolymer latexes such as and ethylene-vinyl acetate copolymers, polyvinyl pyrrolidones, and acrylic ester copolymers. These binders can be used alone or as a mixture.

The mixing ratio of an inorganic pigment, particularly alumina hydrate, to a binder is preferably 1:1 to 30:1, and more preferably 5:1 to 25:1 by weight. The amount of the binder is selected so that cracks do not form in the ink-receiving layer and powder does not fall off the layer.

Silica and colloidal silica having a porous structure similar to alumina hydrate are also used as the inorganic pigments. In addition to the aforementioned binders, which are disclosed in, for example, JP-A No. 61-10483, cation-denatured polyvinyl alcohol or copolymers thereof can be used as the binders.

A layer for protecting an image is disposed on the ink-receiving layer so as to protect physical strength of the ink-receiving layer and durability of an image, and to improve weather resistance. Further, the image protective layer, together with a back coating layer, protects conveyance characteristics and prevents damage which would otherwise be caused by a portion of the ink-receiving layer contacting another portion of the ink-receiving layer when the recording material is in a rolled state.

A layer of an ink-permeable binder containing inorganic pigment particles or resin latex can be disposed as the image protective layer on the ink-receiving layer containing the porous inorganic pigment. The resin latex is used in an amount that does not affect ink permeability, and is preferably monodispersable and thicker than the image protective layer. For example, materials for the image protective layer can be selected from materials disclosed in JP-A No. 11-321080, and used.

The image protective layer to be described below can be disposed on the recording material 62.

The image protective layer is a porous resin made from thermoplastic resin latex. The particle distribution of the latex is particularly important. The average particle size of the resin latex is 0.1 to 10 $\mu$m, preferably 0.3 to 5 $\mu$m, and more preferably 0.3 to 3 $\mu$m. Latex having a monodisperse distribution of particles, which particles are uniform to the extent that 90% or more of the particles belong to an area of the average particle size plus or minus ⅔, is preferable. It is especially preferable that fine particles are not included. A preferable thermoplastic resin latex has a porous structure, has a solid content of particles of about 10 to 60% by weight, does not inhibit ink permeability, and has such a solid content that the particles turn into a transparent resin film by a heat treatment after image formation. Multiple types of thermoplastic resin latex having different MFTs (minimum film-forming temperatures) and high compatibility can also be used.

A thermoplastic resin preferable for use in the present invention is one which turns into a non-porous film by a heat treatment, has a characteristic for protecting an image, and, in particular, contains a component having high ultraviolet absorbancy.

Examples of the thermoplastic resin include vinyl chloride-based materials, vinilydene chloride-based materials, styrene-based materials, acrylic-based materials, urethane-based materials, polyester-based materials, and ethylene-based materials, vinyl chloride-vinyl acetate-based latexes, vinyl chloride-acrylic-based latexes, vinyl chloride-vinylidene chloride-based latexes, vinylidene chloride-acrylic-based latexes, SBR-based latexes, and NBR-based latexes, and latexes of two or more of the materials, such as a mixture of SBR-based latex and NBR-based latex and a mixture of vinyl chloride-acrylic-based latex and vinyl acetate-based latex.

It is preferable that the thermoplastic resin has high light resistance and contains 50% or less of a component containing a conjugate double-bond component. A heat treatment is preferably used as a process for making a porous layer, which contains thermoplastic resin particles, nonporous. By subjecting the layer to the heat treatment, weather resistance such as water resistance and light resistance improves, and gloss can be added to an image. Therefore, printed matter can be stored for a long time.

The heating temperature is preferably at least equal to the temperature at which the thermoplastic resin particles flow, and more preferably, at least equal to the minimum film-forming temperature (MFT). Although the heating temperature varies depending on the type of the thermoplastic resin, the temperature is preferably about 60 to 180° C. in view of surface properties of the film to be obtained. The minimum film-forming temperature is a temperature at which the image protective layer forms a substantially transparent film, and also depends on the processing time.

The image protective layer preferably includes 10 to 30% by weight of silica sol. Silica sol strengthens close contact of the image protective layer with the ink-receiving layer, prevents beading, and improves the sharpness of an image.

In order to improve close contact of the image protective layer with the ink-receiving layer and sharpness of an image, and to maintain the physical strength of the image protective layer, it is preferable to add a hydrophilic binder used in the ink-receiving layer, such as polyvinyl alcohol, to the image protective layer.

An overcoat layer, preferably containing inorganic pigment particles or resin latex and a lubricant, is disposed on the image protective layer. The overcoat layer has a thickness of preferably 0.2 to 2 $\mu$m. A sufficiently thin overcoat layer is advantageous in terms of conveyance characteristics of the inorganic pigment particles or resin latex in the image protective layer, and this advantage can be fully used with the effects of the image protective layer.

A dispersing agent, a thickening agent, a pH adjuster, a lubricant, a fluid denaturing agent, a surfactant, an antifoaming agent, an anti-hydration agent, a fluorescent whitening agent, an ultraviolet absorbent, an anti-oxidizing agent, and the like can also be added to coating solutions for forming the ink-receiving layer and the image protective layer, if necessary.

The back coating layer is disposed on a surface of the support, which surface is opposite to the surface on which the ink-receiving layer is disposed. Conveyance of the recording material in an image recording process can be improved by providing the back coating layer. Further, the back coating layer can protect the ink-receiving layer and simplifies the structure of the image protective layer, whereby defects, which would otherwise occur during the image recording process, are alleviated. After the support has been subjected to a surface treatment or undercoating, hydrophilic binders having a high adhesion, including gelatins or denatured formulations thereof, caseins or denatured formations thereof, polyvinyl alcohols or denatured formations thereof, derivatives such as polyvinyl pyrrolidones, polyethylene oxides, polyacrylic acids, polyacrylic amides, carboxymethyl celluloses, hydroxyethyl celluloses, and hydroxypropylmethyl celluloses can also be used alone or as a mixture. In order to increase the adhesion and physical strength of the back coating layer, a curing agent for the binders is preferably used. Preferable examples of the curing agent include polyvinyl alcohol or copolymers thereof, or other polymers and boric acid or borate. Known curing agents such as epoxy compounds are used for gelatins or denatured formations thereof.

A matting agent is used to improve the conveyance characteristics of the recording material. The matting agent is resin latex or a dispersion of inorganic pigment particles of a particle size sufficiently large for the thickness of a film thereof. The average particle size is larger than the thickness of the dried film of the matting agent, namely, 0.5 to 30 $\mu$m, and preferably 0.5 to 10 $\mu$m. The matting agent is preferably monodispersable. The matting agent is preferably used in an amount which causes 10 to 30 convex portions per 1 $mm^2$ of the surface.

In order to reduce the adhesion of the rolled recording material, a lubricant such as a silicone- or fluorine-containing surfactant is used as a dispersion or a surfactant. The lubricant is preferably used particularly with the matting agent.

The back coating layer has a thickness of 0.2 to 10 $\mu$m, and preferably 0.2 to 5 $\mu$m.

A conveyance roller 64 is disposed above the position at which the recording material 62 is loaded, and a rotation shaft of the conveyance roller 64 is parallel to the core 63. A conveyance roller 66 is disposed at a position away from the conveyance roller 64 by a predetermined distance and at a height which is substantially the same as the conveyance roller 64. The conveyance roller 66 also has a rotation shaft which is parallel to the core 63. Further, a conveyance roller pair 68 is disposed above the conveyance roller 66. The ink jet printer 16 includes an unillustrated motor for pulling out and conveying the recording material 62. The core 63, the conveyance rollers 64 and 66, and the conveyance roller pair 68 are connected via an unillustrated deceleration mechanism to a rotation shaft of the motor. Thus, a driving force from the motor for pulling out and conveying the recording material 62 is transmitted to rotate the core 63, the conveyance rollers 64 and 66, and the conveyance roller pair 68. The recording material 62 which has been pulled out from the magazine is conveyed upwards and then successively wound onto the conveyance rollers 64 and 66. The recording material 62 is conveyed substantially horizontally and at a constant speed between the conveyance rollers 64 and 66. Downstream from the conveyance roller 66, the recording material 62 is substantially vertically conveyed upwards toward the conveyance roller pair 68 at a constant speed.

The recording head 46 is disposed between the conveyance rollers 64 and 66. Lines of nozzles, each of which lines is formed by arranging nozzles so as to extend from one end to the other of the recording material 62 in the transverse direction thereof (i.e., a direction substantially orthogonal to the direction in which the recording material 62 is conveyed), are arranged along the longitudinal direction of the recording material 62 (i.e., the direction in which the recording material 62 is conveyed). Ink chambers, each corresponding to one of the nozzle lines, are formed inside the recording head 46. Main tanks 104, each communicating with one of the ink chambers (see FIG. 3), are attached to the recording head 46. Inks of different colors (such as cyan (C), magenta (M), yellow (Y), and black (BK)) are stored in the respective main tanks 104 and supplied via the ink chambers to the respective nozzle lines. In this way, ink is ejected from the respective nozzles, which ink has a different color for each nozzle line.

Figure 3:
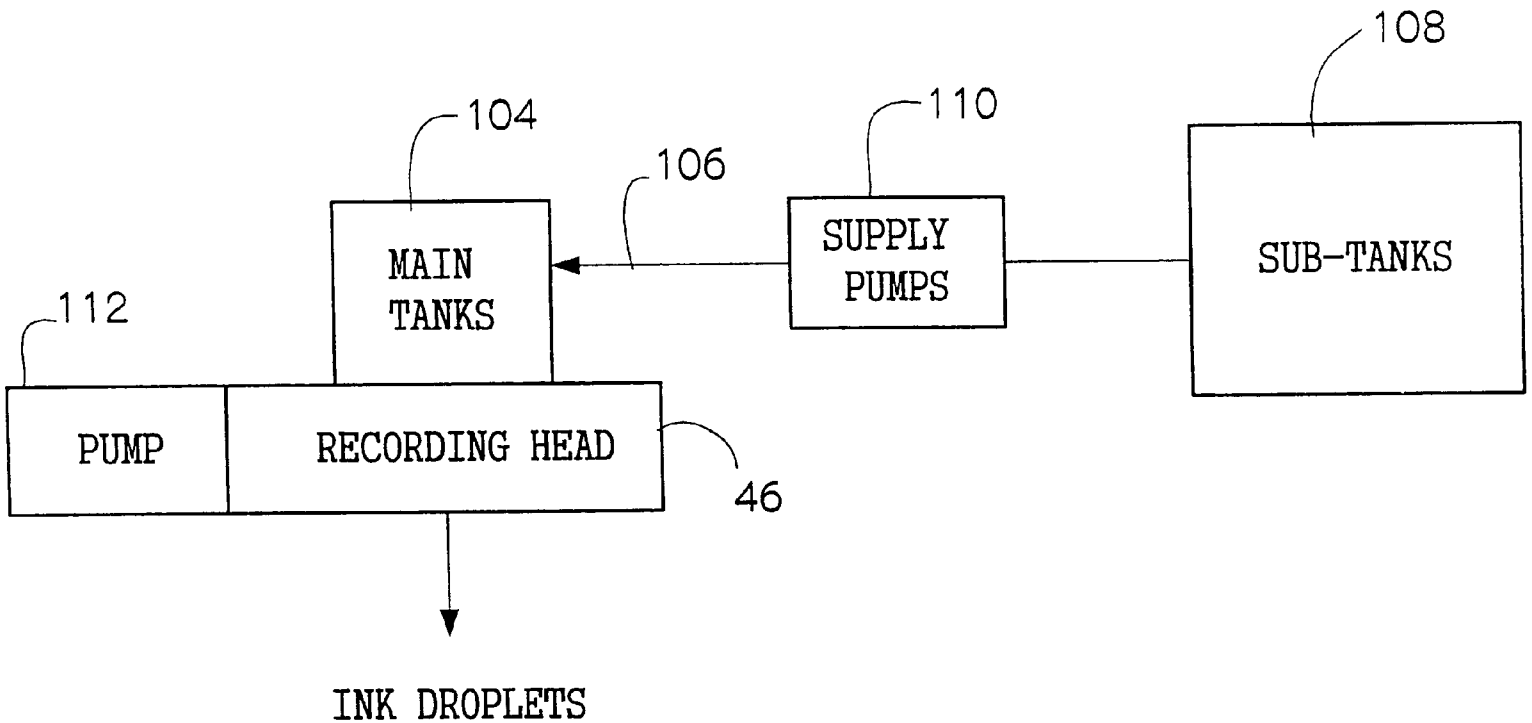
FIG. 3 is a schematic view showing a mechanism for supplying ink to a recording head.

As shown in FIG. 3, in the present embodiment, supply pipes 106 for supplying inks of the respective colors are disposed. One end of each of the supply pipes 106 is connected to one of the main tanks 104, while the other end is connected to sub-tanks 108, which are provided for the respective colors in the same way as the main tanks 104. Supply pumps 110 for supplying ink from the sub-tanks 108 to the main tanks 104 are disposed therebetween.

The main tank 104 that is attached to the recording head 46 has limitations on its ink storage capacity due to the weight, size, and the like of the recording head 46. However, the sub-tank 108 that is separate from the recording head 46 has fewer limitations on the weight or size thereof. Therefore, in the present embodiment, the storage capacity of the sub-tank 108 is significantly larger than that of the main tank 104. As a result, an output of at least 30000 $cm^2$ or more of an image having a print area of 30% is possible without refilling the sub-tanks 108 with ink.

Any known ejection method can be used for ejecting ink from the nozzles. Typical examples of the ejection method which can be used include a method in which ink droplets are ejected from the nozzles by changing the pressure of ink within an ink chamber by applying pulse voltages to piezoelectric elements disposed at the ink chamber and deforming the elements to eject ink droplets from the nozzles, and a thermal method in which ink is heated by heating elements disposed inside the ink chamber such that ink droplets are ejected from the nozzles because of bubbles generated inside the ink chamber by the heating. As shown in FIG. 3, a pump 112, which sucks inks in all of the ink chambers inside the recording head 46 by generating negative pressure, is disposed in order to eliminate blockage in ejection orifices of the nozzles.

The heating and drying section 50 is disposed downstream from the recording head 46 along the direction in which the recording material 62 is conveyed. The heating and drying section 50 includes a heater and a fan, neither is shown, and supplies hot air, which has been generated by the heater and the fan, to the recording material, on which an image has been recorded by ink droplets, which were ejected from the recording head 46, adhering to the recording material. The ink, particularly, a solvent included in the ink, on the recording material is thereby dried.

Further, the laminating section 52 for forming a transparent polymer film on the surface of the recording material 62 is disposed downstream from the heating and drying section 50 along the direction in which the recording material 62 is conveyed. The transparent polymer film improves water resistance and durability of an image, and maintains high image quality for a long period of time. The term "transparent" described herein refers to a state in which an image formed on the recording material can be observed through the polymer film. Materials for the transparent polymer film are not particularly limited, and various polymer materials can be used. Namely, water-soluble polymers such as gelatins or polyvinyl alcohols, or hydrophobic polymers such as polymethyl methacrylates may be used.

Examples of a method for forming the transparent polymer film include: (1) a method in which a transparent polymer film formed in advance is attached to the recording material; (2) a method in which a polymer solution is applied onto the recording material; (3) a method in which, after an image is formed, a liquid coating agent is applied onto the surface of the recording material and the applied coating agent is solidified with ultraviolet or infrared rays to form a transparent overcoat layer; (4) a method in which a thermoplastic resin porous layer is formed on the surface of the recording material in advance, and, after an image is formed, the thermoplastic resin porous layer is made dense by heating, and pressing if necessary, to form a transparent resin film; and (5) a method in which a polymer in the form of latex is applied onto the recording material or may be applied onto the entire surface of the recording material using an ink jet device, and the polymer is heated and melted to form a transparent resin film.

In the present embodiment, the laminating section 52, which forms a transparent polymer film in accordance with the method (1), is provided. However, other methods may also be used. For example, when the method (4) is used, a transparent polymer film may also be formed by the heating and drying section 50 heating the recording material 62, which has a thermoplastic resin porous layer formed thereon in advance. Alternatively, a heating section for forming a transparent polymer film may be separately provided.

Figure 4:
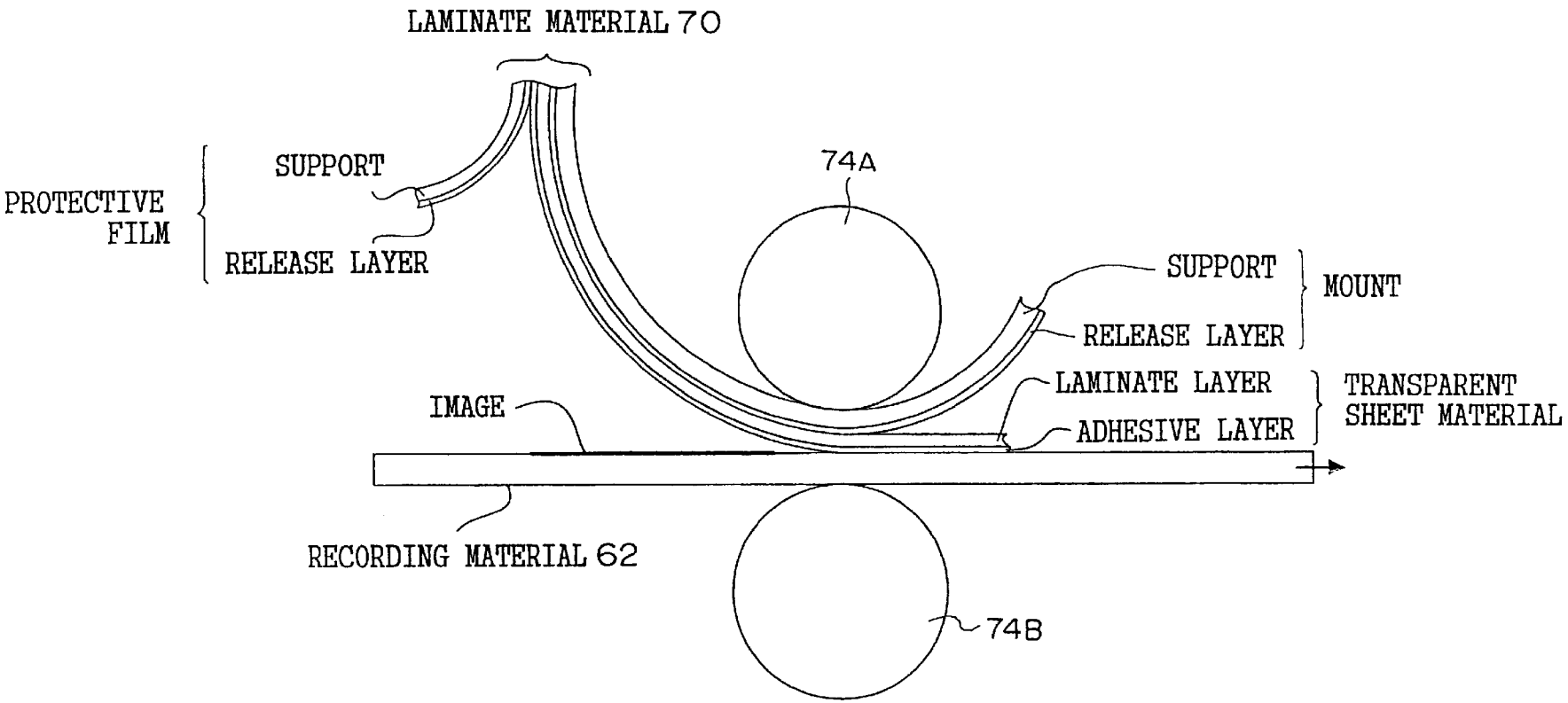
FIG. 4 is an image view for explaining lamination of a transparent sheet material onto a recording material.

The laminating section 52 relating to the present embodiment includes a shaft 72, which supports a sheet of laminate material 70 shaped into a roll, heat rollers 74A and 74B, which are disposed so as to nip the recording material 62 and the laminate material 70, and take-up rollers 76 and 78. As shown in FIG. 4, the laminate material 70 relating to the present embodiment has a structure in that front and rear surfaces of a transparent sheet material, which includes a laminate layer (transparent polymer film) and an adhesive layer, are covered with a mount formed by a support and a release layer, and a protective film formed by a support and a release layer, respectively.

The protective film is separated from the laminate material 70, which has been pulled out from the roll, by being taken up by the take-up roller 76, and the laminate material 70 whose protective film has been separated is sent between the heat rollers 74A and 74B to be laid on the image recording surface of the recording material 62. By the laminate material 70 being heated and pressed by the heat rollers 74A and 74B, the adhesive layer of the transparent sheet material adheres to the image recording surface of the recording material 62, and the release layer of the mount is released from the laminate layer of the transparent sheet material and taken up by the take-up roller 78. In this way, the laminate layer (transparent polymer film) is formed on the image recording surface of the recording material 62 as an uppermost layer.

The image reading section 54, which includes a three-linear CCD sensor or an area sensor 80 for reading a color image (output image) recorded on the recording material 62, is disposed downstream from the laminating section 52 along the direction in which the recording material 62 is conveyed. The CCD sensor 80 is a part of the image reading section 54. Image signals outputted from the CCD sensor 80 are inputted to the printer control section 42 as output image data representing an output image via an amplifier, an A/D converter, and a correction section, which carries out corrections such as dark correction, all of which are unillustrated and also included in the image reading section 54.

The conveyance roller pairs 82 and 84 are sequentially disposed above the conveyance roller pair 68 with a predetermined gap therebetween. The conveyance roller pairs 82 and 84 are connected via the unillustrated deceleration mechanism to the rotation shaft of the unillustrated motor for intermittent conveyance, such that a driving force of the motor is transmitted to rotate the roller pairs 82 and 84. The first cutter 56 for cutting the recording material 62 along the transverse direction thereof is disposed between the conveyance roller pairs 82 and 84. As an example, FIG. 2 shows the first cutter 56, which is structured such that a pair of long blades are opposite each other with the recording material 62 being conveyed therebetween. However, the structure of the first cutter 56 is not limited to this structure. The first cutter 56, which has the same structure as the second cutter 58 to be described later, namely, the first cutter 56, which cuts the recording material 62 by moving a rotary blade along the transverse direction of the recording material 62, may also be used.

When the first cutter 56 cuts the recording material 62, conveyance of the recording material 62 needs to be stopped. Therefore, the printer control section 42 intermittently conveys the recording material 62 by intermittently driving the motor for intermittent conveyance to rotate the conveyance roller pairs 82 and 84 intermittently, such that portions of the recording material 62, at which boundaries between adjacent recorded images extend in the transverse direction of the recording material 62 (i.e., portions of the recording material 62 to be cut by the first cutter 56), are successively positioned at a cutting position for the first cutter 56.

However, the recording material 62 is conveyed at a constant speed, as described above, upstream from the conveyance roller pair 82 along the conveyance path of the recording material 62. The different conveyance patterns of the recording material 62 at a boundary portion between the conveyance roller pairs 68 and 82 where these patterns meet is compensated for by forming a loose portion (loop) of the recording material 62 between the conveyance roller pairs 68 and 82, as shown by an imaginary line in FIG. 2.

Further, conveyance belts 86 and 88 are disposed above the conveyance roller pair 84 at different heights. Each of the conveyance belts 86 and 88 is formed by a seamless belt being wound around a pair of rollers. One roller of each of the pairs 86 and 88 is connected to a rotation shaft of the belt driving motor via the unillustrated deceleration mechanism. The driving force of the belt driving motor is transmitted to rotate the rollers.

An unillustrated conveyance mechanism for conveying a piece of the recording material 62, which has been cut by the first cutter 56, is disposed between the conveyance roller pair 84 and the conveyance belt 88, and between the conveyance belts 86 and 88. Whether the piece of the recording material 62 which has been cut is transferred to the conveyance belt 86 or the conveyance belt 88 can be selected by selecting whether only the conveyance mechanism disposed between the conveyance roller pair 84 and the conveyance belt 88 is operated or whether both the conveyance mechanism disposed between the conveyance roller pair 84 and the conveyance belt 88 and the conveyance mechanism disposed between the conveyance belts 86 and 88 are operated. The piece of the recording material 62 which has been transferred to the conveyance belt 86 or 88 is conveyed substantially horizontally by the conveyance belts 86 or 88.

A conveyance belt 90 is disposed downstream from the conveyance belt 86 at a predetermined interval in the direction in which the recording material is conveyed by the conveyance belt 86. The conveyance belt 90 is also formed by a seamless belt being wound around a pair of rollers. One of the rollers is connected to the rotation shaft of the belt driving motor via the deceleration mechanism, and is rotated by the driving force of the belt driving motor being transmitted to the roller. As a result, the piece of the recording material 62, which has been conveyed by the conveyance belt 86, is transferred to the conveyance belt 90, which in turn conveys the piece substantially horizontally further downstream.

The second cutter 58 is disposed between the conveyance belts 86 and 90. The second cutter 58 includes two cutter mechanisms 92A and 92B, which are disposed at different positions along a direction orthogonal to the direction in which the recording material 62 is conveyed by the conveyance belts 86 and 90. As shown in FIG. 5, each of the cutter mechanisms 92A and 92B includes a rotary blade 94 and a pulley 96. The rotary blade 94 is a thick disc, and a blade is formed around its periphery. The rotary blade 94 is disposed and rotatably supported by a shaft at an upper surface side of the recording material 62, which is conveyed by the conveyance belts 86 and 90. The pulley 96 is a thick disc, and a groove is formed on its periphery. The pulley 96 is disposed and rotatably supported by a shaft at a lower surface side of the recording material 62.

Figure 5A:
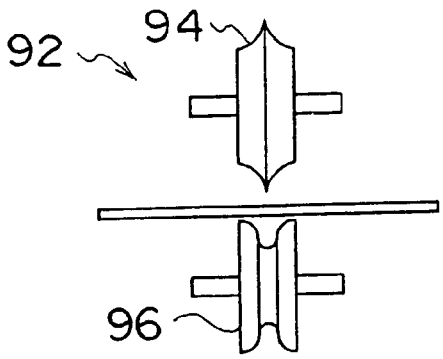
FIGS. 5A and 5B are schematic views of a cutter mechanism for a second cutter.
Figure 5B:
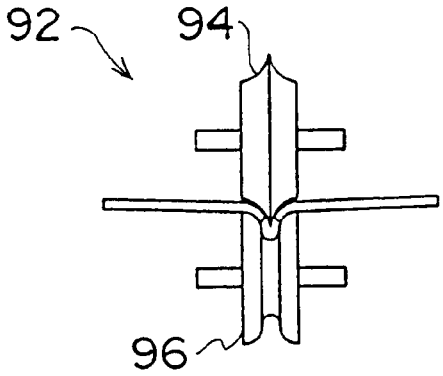

The rotary blade 94 of each of the cutter mechanisms 92A and 92B is movable between a first position, which is spaced from the recording material 62 as shown in FIG. 5A, and a second position, at which the blade formed around the periphery is pressed against the recording material 62 and rotated with the conveyance thereof, as shown in FIG. 5B. The pulley 96 is also rotated along with the rotation of the rotary blade 94. While the rotary blade 94 is located at the first position, the piece of the recording material 62, which is conveyed by the conveyance belts 86 and 90, is cut at the positions of the rotary blades 94 along the direction in which the piece is being conveyed. The second cutter 58 includes a mechanism for independently and vertically moving the rotary blades 94 of the cutter mechanisms 92A and 92B. Vertical movement of the rotary blades 94 is controlled by the printer control section 42.

Conveyance belts 98 and 100 are disposed downstream from the conveyance belts 90 and 88, respectively, in the direction in which the recording material 62 is conveyed by the conveyance belts 90 and 88. The conveyance belts 98 and 100 have the same structures as those of the conveyance belts 86, 88, and 90, except that they convey the recording material 62 in a direction which is different by 90° from the direction in which the recording material 62 is conveyed by the conveyance belts 86, 88, and 90; the conveyance belts 98 and 100 are also driven, by the driving force of the belt conveying motor being transmitted thereto, to convey the recording material 62, which has been transferred from the conveyance belt 90 or 88, in the direction different by 90° from the direction in which the recording material 62 has been conveyed by the conveyance belts 86, 88, and 90.

The conveyance path of the recording material 62 conveyed by the conveyance belts 86, 90, and 98, and the conveyance path of the recording material 62 conveyed by the conveyance belts 88 and 100 correspond to the first and second conveyance paths of the present invention, respectively. The conveyance belt 98 is narrow since the conveyance belts 86, 90, and 98 convey pieces of the recording material 62 which are short in the direction in which the conveyance belt 98 is rotated (i.e., in the longitudinal direction of the recording material 62 before cutting). The conveyance belt 100 is wider than the conveyance belt 98 because the conveyance belts 88 and 100 might convey pieces of the recording material 62 which are long in the direction in which the conveyance belt 100 is rotated (i.e., in the longitudinal direction of the recording material before cutting).

A print accumulating section 60 is disposed downstream from the conveyance belts 98 and 100 in the direction in which the recording material 62 is conveyed by the conveyance belts 98 and 100. The print accumulating section 60 includes a base 60A and a sorter 60B which is slidable substantially vertically with respect to the base 60A (i.e., in a direction of arrow A in FIG. 2). The base 60A houses a mechanism for slidably moving the sorter 60B. The sorter 60B has base plates 102, which are substantially vertically arranged at intervals, and are inclined with respect to a horizontal direction. An accommodating portion for accommodating the recording material 62 having an image recorded thereon is formed between the base plates 102. Sliding movement of the sorter 60B is controlled by the printer control section 42. The print accumulating section 60 and the printer control section 42 correspond to the accumulating means of the present invention.

Operation of the present embodiment will be described next. When the magazine accommodating the roll of the recording material 62 therein is set in the casing of the ink jet printer 16 and recording of images onto the recording material 62 is instructed, the printer control section 42 controls the driving of the motor for pulling out and conveying the recording material 62 so that the recording material 62 is pulled out and conveyed. When it is determined that a leading end of the recording material 62 has reached the position at which images are to be recorded, images are recorded onto the recording material 62 by the recording head 46. This determination can be carried out by detecting the passage of the recording material 62 by a passage detection sensor disposed along the conveyance path, or by detecting the amount of the recording material 62 which has been pulled out and conveyed.

Figure 6A:
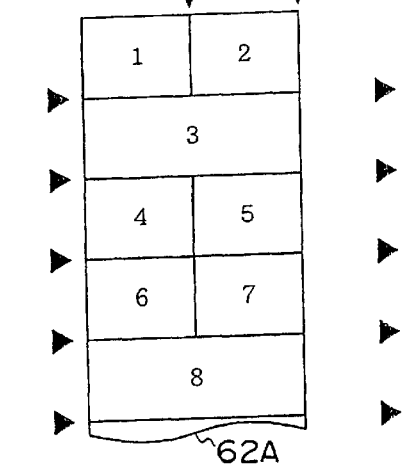
FIGS. 6A through 6E are image views showing examples of recording formats.
Figure 6B:
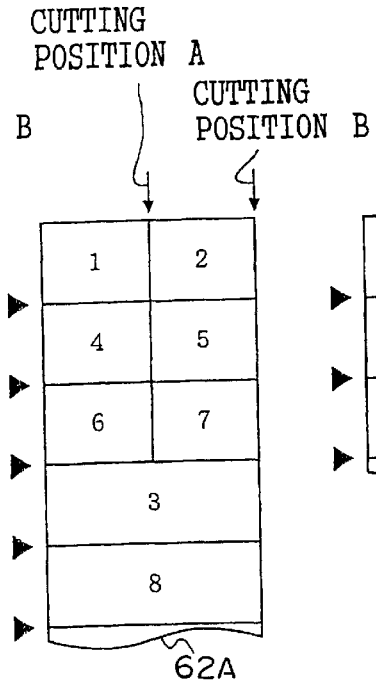
Figure 6C:
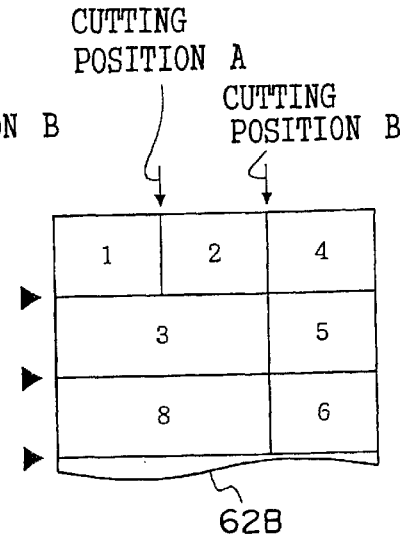
Figure 6D:
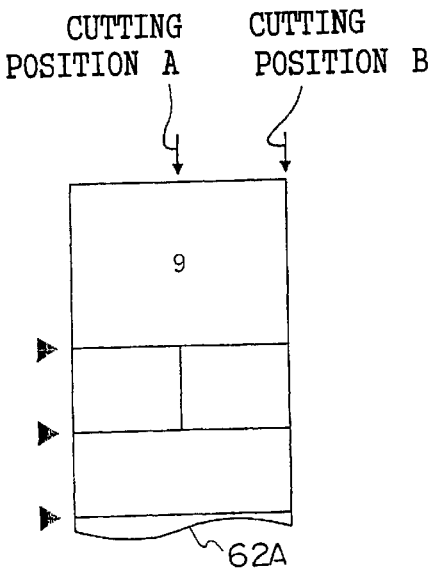
Figure 6E:
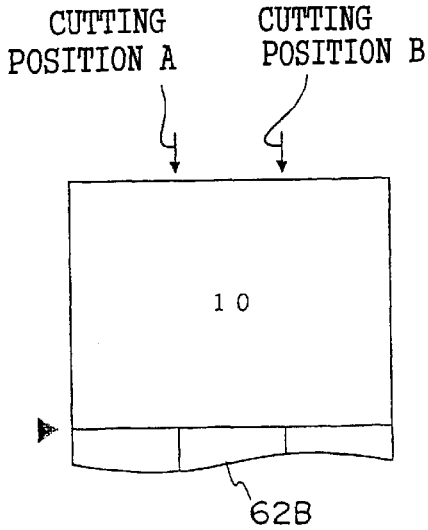

Images are recorded onto the recording material 62 as follows. A recording material 62A or 62B can be set in the ink jet printer 16 relating to the present embodiment. As shown in FIGS. 6A, 6B, and 6D as an example, the recording material 62A has such a width that two regular-sized (e.g., 127 mm×178 mm) images (i.e., images indicated by numerals 1, 2, 4, 5, 6, and 7 in FIGS. 6A and 6B) can be recorded along the transverse direction of the recording material 62. As shown in FIGS. 6C and 6E as an example, the recording material 62B has such a width that three regular-sized images can be recorded along the transverse direction of the recording material 62.

In the present embodiment, various image recording formats are defined in advance, with a piece of the recording material 62 cut by the first cutter 56 serving as a unit. A recording format A1 in which two regular-sized images are recorded along the transverse direction of the recording material 62A, a recording format A2 in which one panorama-size image (i.e., image indicated by numerals 3 or 8 in FIGS. 6A and 6B) is recorded over the entire width of the recording material 62A, and a recording format A3 in which one large image, whose area is four times that of the regular-sized image (i.e., image indicated by numeral 9 in FIG. 6D), is recorded over the entire width of the recording material 62A, are prepared as the image recording formats for pieces of the recording material 62A.

Further, a recording format B1 in which three regular-sized images are recorded along the transverse direction of the recording material 62B, a recording format B2 in which one regular-sized image and one panorama-size image are recorded along the transverse direction of the recording material 62B, and a recording format B3 in which one over-sized image, whose area is nine times that of the regular-sized image (i.e., image indicated by numeral 10 in FIG. 6E), is recorded over the entire width of the recording material 62B, are prepared as the image recording formats for pieces of the recording material 62B.

Positions each referred to as a "cutting position A" in FIGS. 6A through 6E represent positions at which the recording materials 62A and 62B are to be cut by the cutter mechanism 92A, while positions each referred to as "cutting position B" represent positions at which the recording materials 62A and 62B are to be cut by the cutter mechanism 92B. Comparing FIGS. 6A, 6B, and 6D with FIGS. 6C and 6E, it is clear that the recording materials 62A and 62B are conveyed so that ends in the transverse direction thereof (i.e., left ends in FIGS. 6A through 6E) pass through predetermined positions, and that the cutter mechanisms 92A and 92B are disposed at positions corresponding to the boundaries of images in the recording formats A1, B1, and B2.

The printer control section 42 reads, from the image data accumulating section 40, image data for frames of images to be recorded, and determines the size of the respective images to be recorded. Based on the recording size of the images and the width of the recording material 62, which has been set in the ink jet printer 16, the recording format (and recording order) for recording the images onto the recording material 62 are determined, starting from pieces to be formed at the leading end of the recording material 62. The determined recording format is stored in a memory or the like for controlling the first cutter 56, the recording material conveyance section 48, and the second cutter 58. The control of these components will be described later.

For example, when the recording size of the images 1, 2, and 4 to 7 is regular-sized and the recording size of the images 3 and 8 is panorama-size, as shown in FIG. 6A, the images 1 and 2 are recorded on a first piece in the recording format A1, the image 3 is recorded on a second piece in the recording format A2, the images 4 to 7 are recorded on a third piece and a fourth piece in the recording format A1, and the image 8 is recorded on a fifth piece in the recording format A2. In this way, the recording format for each piece is successively determined so that the order of images corresponds to the recording order.

Alternatively, based on the recording sizes of respective images, which have been determined by reading image data for recording of a larger number of images, the recording order of the images may be determined first, and then the recording format for each piece may be determined, such that pieces are successively formed in the same recording format. For example, in FIG. 6B, by changing the recording order such that the image 3 is recorded on the fourth piece after recording of the images 4 to 7 on the second and third pieces, the first to third pieces are formed in accordance with the recording format A1, and the fourth and fifth pieces are formed in accordance with the recording format A2. Further, the first and second pieces may be formed in accordance with the recording format A2 and the third to fifth pieces may be formed in accordance with the recording format A1, although this is not shown.

In the present embodiment, the recording materials, which have been cut for each image (hereinafter referred to as "prints"), are sorted into prints of images whose original images are recorded on the same photographic film, and the sorted prints are separately accommodated in accommodating portions of the print accumulating section 60. Therefore, prints can also be accumulated and accommodated in the accommodating portions based on the size by determining the recording order and the recording format for each piece such that pieces are successively formed in the same format, as described above.

After the recording order and the recording format for each piece have been determined as described above, based on the image data for recording the respective images, image signals representing the timing for driving the nozzles of the recording head 46 (e.g., timing for actuating piezoelectric elements or heating elements which are provided corresponding to the respective nozzles) are generated for each image, such that each image is recorded on the recording material 62 line by line for each of the color components (e.g., C, M, Y, and BK) in accordance with the recording order and recording format which have been determined for each piece. The generated image signals are outputted to the driver 44.

Based on the image signals inputted from the print control section 42, the driver 44 for the recording head 46 generates ejection signals for selectively driving the nozzles at a timing corresponding to the image signals (e.g., selectively actuating the piezoelectric elements or the heating elements for the respective nozzles), and the generated ejection signals are transmitted to the recording head 46. Subsequently, ink droplets, which have been ejected from the respective nozzles of the recording head 46 at a timing corresponding to the image signals, adhere to the recording material 62, and the recording material 62 is sub-scanned by being conveyed at a predetermined conveyance speed. As a result, images (image pieces) are successively recorded, line by line, over the entire width of the recording material 62.

The recording material 62 having images recorded thereon by the recording head 46 is exposed to hot air generated by the heating and drying section 50, such that the solvent included in the ink droplets adhering to the recording material 62 is dried and therefore removed. The transparent sheet material of the laminate material 70 is made to adhere to (is laminated onto) the image recording surface by the laminate section 52. The laminated recording material 62 is conveyed toward the position at which the first cutter 56 is disposed, after the images recorded on the recording material 62 have been read by the image reading section 54.

When the leading end of the recorded recording material 62 reaches the position at which the first cutter 56 is disposed, the printer control section 42 drives the motor for intermittent conveyance. The conveyance roller pairs 82 and 84 are rotated until one of the portions of the recording material 62, where the boundaries of the recorded images extend along the transverse direction of the recording material 62 (i.e., the boundaries of the pieces indicated by symbols ▲ in FIGS. 6A through 6E), is positioned at the cutting position for the first cutter 56. Thereafter, the driving of the motor for intermittent conveyance is stopped so that rotation of the conveyance roller pairs 82 and 84 is stopped. Subsequently, the first cutter 56 is operated while the conveyance of the recording material 62 is stopped, so as to cut the recording material 62.

By the printer control section 42 repeating the above processings, the recorded recording material 62 is cut into pieces, which are sequentially conveyed downstream. The length of the respective pieces along the direction in which the recording material 62 is conveyed is not necessarily the same, but varies according to the recording formats of the respective pieces. Therefore, the printer control section 42 determines the distance to a subsequent portion of the recording material 62 to be cut (i.e., the amount of the recording material 62 to be conveyed) by sequentially reading the recording format for each of the pieces stored in the memory or the like, and drives the motor for intermittent conveyance based on the results of this determination, such that the subsequent portion of the recording material 62 to be cut (i.e., the boundary of the subsequent piece) is positioned on the cutting position for the first cutter 56.

Further, every time the first cutter 56 is operated, the printer control section 42 determines, based on the recording format of a piece which has been cut off by the first cutter 56, whether the piece of the recording material 62 should be transferred onto the conveyance belt 88 or 86. For example, when the piece of the recording material 62 has been cut in accordance with any one of the recording formats A1, B1, and B2, the piece needs to be further cut for each image by the second cutter 58. Therefore, the conveyance mechanism disposed between the conveyance roller pair 84 and the conveyance belt 88, and the conveyance mechanism disposed between the conveyance belts 86 and 88 are operated such that the piece of the recording material 62 is transferred onto the conveyance belt 86. Further, for example, when the piece of the recording material has been cut in accordance with the recording format B3, only the conveyance mechanism disposed between the conveyance roller pair 84 and the conveyance belt 88 is operated so that the piece of the recording material 62 is transferred onto the conveyance belt 88 and conveyed to the print accumulating section 60 by the wide conveyance belt 100.

In addition to controlling the transfer of the piece of the recording material 62, the printer control section 42 switches the position of the second cutter 58 in accordance with the recording format of the piece, which has been transferred to the conveyance belt 86. Namely, when the recording format of the piece that has been transferred to the conveyance belt 86 is A1, the rotary blade 94 of the cutter mechanism 92A is moved to the first position, and the rotary blade 94 of the cutter mechanism 92B is moved to the second position. When the recording format of the piece that has been transferred to the conveyance belt 86 is B1, the rotary blades 94 of the cutter mechanisms 92A and 92B are respectively moved to the first positions. When the recording format of the piece that has been transferred to the conveyance belt 86 is B2, the rotary blade 94 of the cutter mechanism 92A is moved to the second position, and the rotary blade 94 of the cutter mechanism 92B is moved to the first position.

The piece of the recording material 62, which has been transferred to the conveyance belt 86, is then cut for each image by one or both of the rotary blades 94 at the first position(s), which rotary blades 94 are being rotated by the conveyance of the piece, whereby the piece is cut along the direction in which the piece is conveyed. In general, the recorded images are mainly regular-sized. In the case of a recording format including regular-sized images, the pieces of the recording material 62 need to be cut by the second cutter 58. However, in the structure of the present embodiment, it is not necessary to stop conveying the piece when the piece is cut by the second cutter 58. Therefore, in the ink jet printer 16, the processing time required for a single image can be reduced.

As for the transfer of the pieces which have been cut in accordance with the recording formats A2 and A3, although the pieces can be transferred onto the conveyance belt 86 and conveyed to the print accumulating section by the conveyance belt 98, the pieces do not need to be cut by the second cutter 58. Therefore, it is preferable that the pieces be transferred onto the conveyance belt 88. As a result, when the recording material 62A is set in the inkjet printer 16, only pieces formed in accordance with the recording format A1 are transferred onto the conveyance belt 86 and pass through the position at which the second cutter 58 is disposed. Thus, it is not necessary to switch the position of the second cutter 58.

Further, the printer control section 42 controls the sliding movement of the sorter 60B so that, of the recording material 62 (prints) that is cut for each image and conveyed by the conveyance belt 98 or 100, prints whose images correspond to the original images recorded on the same photographic film are accommodated in the same accommodating portion formed at the sorter 60B. As a result, an operator does not need to sort the accumulated prints into prints corresponding to the same photographic film, and workload of the operator can be alleviated.

Instead of sorting and accumulating prints based on a single photographic film as described above, prints may be sorted and accumulated based on an order. For example, when photographic films are brought in and printing is requested by a user, sorting and accumulation are carried out based on this order.

Next, a processing ability maintenance process, which is carried out by the printer control section 42, will be described. In the processing ability maintenance process carried out by the printer control section 42, while multiple images are sequentially recorded on the recording material 62, occurrence of the following events is checked: (1) blockage in the ejection orifice of the recording head 46; (2) a decrease in the amount of ink ejected from the recording head 46; (3) a defective output image due to other causes; (4) a decrease in the capacity of the image data storage section 40; and (5) consumption of all of the recording material 62. These events are obstacles to image recording in the present invention.

Occurrence of the events (1) to (3) is checked using output image data, which has been inputted from the image reading section 54. Specifically, the printer control section 42 makes the image reading section 54 read a part or all of an output image (preferably every, every other frame or every several frames), which is outputted after the image has been recorded on the recording material 62 by the ink jet printer 16, and thereby obtain output image data.

Image data for recording, which is inputted from the image processing device 14 to the ink jet printer 16 and stored in the image data storage section 40, is stored therein until it is determined that the corresponding output image has appropriate image quality. Therefore, first, in order to compare the obtained output image data with the image data for recording, the printer control section 42 carries out image processings on at least one of the output image data and the image data for recording, such as resolution conversion for making the resolution correspond to that of the other image data, density conversion for making the average density of an image correspond to that of the other image data, and the like.

Each of the output image data and the image data for recording may also be converted to image data having the same or a lower resolution, such that deterioration in the accuracy of determination of the processing to be described later, which deterioration is caused by slight misalignment of the positions of pixels, is avoided, and the processing time is reduced.

Next, using the output image data and the image data for recording, which have been subjected to the above image processings, a density of each color component for each pixel of the output image data is compared with that of the image data for recording, and it is determined whether there is a pixel whose density value for each color component of the output image data is different from that of the image data for recording by a predetermined value or more, which predetermined value is set in consideration of an error. When the difference between the densities of the respective color components for each pixel of the output image data and the densities of the respective color components for each pixel of the image data for recording are less than the predetermined values, the image quality of the output image is appropriate and substantially corresponds to the image represented by the image data for recording. Therefore, it can be determined that the events (1) to (3) have not occurred. Thus, the processing with respect to the output image is completed, and the corresponding image data for recording is erased from the image data storage section 40.

When the output image data has a pixel whose densities for the respective color components are different from those of the image data for recording by the predetermined values or more, the number and distribution of similar pixels on the image are determined. For example, when the output image data has a small number of pixels whose densities for the respective color components differ from those of the image data for recording by the predetermined values or more, and the distribution of such pixels does not concentrate on a particular portion of the image, observable change in the image quality is not seen, and it can be determined that the events (1) to (3) have not occurred. Therefore, the processing with respect to the corresponding output image is completed, and the corresponding image data for recording is erased from the image data storage section 40.

In the case in which only a part of the output image is read, the image data for recording on images which are not to be read can be erased from the image data storage section 40 when it is determined that the events (1) to (3) have not occurred in the image which has been read and is the closest to the images which are not to be read, such as the image immediately before or after the images which are not to be read in the order of recording the images on the recording material 62.

Further, when there is a predetermined number or more of the pixels whose densities for the respective color components differ from those of the image data for recording by the predetermined values or more, it is determined that the events (1) to (3) might occur, and erasing of the corresponding image data for recording from the image data storage section 40 is suspended. Moreover, it is determined whether such pixels are successively present along the longitudinal direction of the recording material 62 (i.e., the direction in which the recording material 62 is conveyed).

When an ejection orifice of a particular nozzle of the recording head 46 relating to the present embodiment is blocked, and ink of a particular color is not ejected from the ejection orifice or the amount of ink of a particular color ejected from the ejection orifice becomes small, streaks which lack the particular color are successively formed on an output image as defects along the longitudinal direction of the recording material 62.

When the ejection orifice of a particular nozzle of the recording head 46 is blocked, similar defects are formed on an output image. However, in the present embodiment, the size of recorded images and the recording formats for respective pieces (i.e., recording ranges of respective images along the transverse direction of the recording material 62) are not fixed. Therefore, when the aforementioned defects are detected, it is determined whether the defects are also present in output images which have been recorded around the same time and whose recording ranges along the transverse direction of the recording material 62 is the same or partially overlapped. In this way, accuracy of the determination of blockage in the ejection orifice can further be improved.

When the above conditions are met, the printer control section 42 determines that the event (1) has occurred, namely, the ejection orifice of the particular nozzle of the recording head 46 is blocked. The printer control section 42 temporarily stops image recording from being carried out by the recording head 46, and eliminates the blockage in the ejection orifice by operating the pump 112. When ejection orifices of multiple nozzles are blocked, a defect might be formed at a portion or all of an output image, or an image might not be recorded at all. Such a case meets the above conditions as well, and therefore, the processing for eliminating the blockage in the ejection orifices of the recording head 46 is carried out. The output image whose defect has been detected is discarded as a defective image. Further, after it is determined that the blockage in the ejection orifices has been eliminated, an image is recorded again using the image data for recording, which is stored in the image data storage section 40.

Image recording needs to be temporarily stopped as described above, in order to operate the pump 112. Therefore, when a change in the density (i.e., a decrease in the amount of ink ejected) of an output image caused by the blockage in the ejection orifice is relatively small and a nozzle having a blocked ejection orifice can be specified, in place of operating the pump 112, only an ejection signal for driving the specified nozzle can be changed so as to compensate for the change in the density caused by the blockage in the ejection orifice.

When the output image data has a predetermined number or more of pixels whose densities for the respective color components differ from those of the image data for recording by the predetermined values or more, and such pixels are substantially evenly distributed over the entire output image, namely, when the color of the entire image is changed, the printer control section 42 determines that the event (2) has occurred for a particular color, namely, that the amount of ink of a particular color ejected from the recording head 46 has decreased. The printer control section 42 temporarily stops image recording carried out by the recording head 46, and supply ink of the particular color from the sub-tank 108 to the main tank 104 by operating the supply pump 110.

Therefore, when the amount of ink ejected is decreased by insufficient supply of ink to the recording head 46, the decrease in the amount of ink ejected can be eliminated by operating the supply pump 110 as described above. Further, an output image meeting the above conditions is discarded as a defective image. Further, after it is determined that the problem of the insufficient supply of ink has been eliminated, an image is recorded again using the image data for recording, which is stored in the image data storage section 40.

When the amount of ink ejected from the recording head 46 is decreased, the color of output images successively recorded often changes. Namely, the output image data has a predetermined number or more of pixels whose densities for the respective color components differ from those of the image data for recording by the predetermined values or more, and such pixels are substantially evenly distributed over the entire output images. Therefore, when deterioration in image quality as described above is detected, it is determined whether the color changes are present in output images, which have been recorded around the same time the defective output images have been recorded. In this way, the accuracy of the determination of a decrease in the amount of ink ejected from the recording head 46 can further be improved.

A decrease in the amount of ink ejected from the recording head 46 might not be eliminated even if the supply pumps 110 are operated, because the amount of ink might also be decreased by factors other than insufficient ink supply. In such a case, in place of operating the supply pumps 110, only an ejection signal for driving nozzles, which eject an insufficient amount of ink of a particular color, can be changed so as to compensate for the decrease in the amount of ink ejected (i.e., a decrease in the density).

When the amount of ink ejected from the recording head 46 substantially decreases, and the substantial decrease in the amount of ink cannot be eliminated by operating the supply pumps 110, breakdown of the supply pumps 110 or consumption of all of the ink stored in the sub-tanks 108 might be the cause. In this case, it is difficult to increase the amount of ink ejected even if an ejection signal is changed. Thus, an operator is called by activating an alarm. Therefore, a decrease in the number of prints processed per unit time can be prevented by continuing the state in which the amount of ink ejected is extremely low, namely, the state in which images cannot be recorded normally.

When deterioration in image quality such as the above-described defects or change in color is detected with respect to a particular output image, and yet similar deterioration in image quality is not observed in other output images, it can be determined that the detected change in image quality is a temporary change accidentally caused by, for example, the image data for recording being changed for some reason during transfer thereof, or by a temporary change in the power-supply voltage during image recording. Therefore, in the above case, the printer control section 42 determines that a defective output image is formed by the event (3), namely, other factors, and an image, which corresponds to only a particular output image whose deteriorated image quality has been detected, is recorded again, using the same image data for recording. As a result, an output image having appropriate image quality can be obtained.

Occurrence of the event (4), namely, a decrease in the capacity of the image data storage section 40, is checked by constantly monitoring the capacity of the image data storage section 40. Specifically, the printer control section 42 stores the capacity of the image data storage section 40. When the image data for recording, which has been outputted from the image processing device 14, is stored in the image data storage section 40, the printer control section 42 decreases the capacity of the image data storage section 40 by an amount corresponding to the amount of the image data for recording. When it is determined that an output image has appropriate image quality, and the corresponding image data for recording is erased from the image data storage section 40, the capacity increases by an amount corresponding to the amount of the erased image data for recording.

Every time the data stored in the image data storage section 40 is updated, it is determined whether the capacity after the update is equal to or less than a predetermined value. When the determination is negative, no processing is carried out. However, when, because of the above-described blockage in the ejection orifice of the recording head 46, image recording needs to be temporarily stopped so that the pumps 112 are operated, and an image corresponding to a defective output image needs to be recorded again, the capacity of the image data storage section 40 monotonously decreases until the re-recording of the image is completed. Therefore, it is highly likely that the determination becomes affirmative. When the determination is affirmative, the printer control section 40 requests the image processing device 14 to temporarily stop the output of the image data for recording.

With the above structure, it is possible to prevent a disadvantage that images cannot be recorded by the ink jet printer 16 because the image data storage section 40 becomes full while the image data for recording inputted from the image processing device 14 is being stored in the image data storage section 40, whereby transfer sequence for transferring the image data for recording is stopped halfway, or a disadvantage that a processing carried out by the image processing device 14 is stopped halfway.

When images are recorded onto the recording material 62 by using image data, which is sequentially outputted from the film scanner 12 sequentially reading film images, instead of requesting the image processing device 14 to stop outputting the image data for recording as described above, the printer control section 42 may request the film scanner 12 to temporarily stop reading the film images.

In the case of the event (5), consumption of all Of the recording material 62 can be detected by determining whether load, which is applied to the motor for pulling out and conveyance when the motor is driven, is equal to or less than a predetermined value. When it is determined that all of the recording material 62 accommodated in the magazine has been consumed, an operator is called by activating an alarm. Therefore, by continuing the state in which the magazine has not been replaced, namely, the state in which images cannot be recorded, a decrease in the number of prints processed per unit time can be prevented.

Hereinafter, a processing for maintaining processing capability, which is carried out by the image processing section 38 of the image processing device 14, will be briefly described. In the processing for maintaining processing capability carried out by the image processing section 38, while multiple images are sequentially recorded on the recording material 62, occurrence of the following events is checked: (6) a breakdown of the film scanner 12; and (7) an error in reading the photographic film 24 by the film scanner 12. These events are obstacles to image recording as well.

When an error has occurred in communication with the film scanner 12, the image processing section 38 determines that the event (6), namely, a breakdown, has occurred. Further, for example, when a defect, such as all the pixels having extremely low or high densities, is caused with respect to image data which has been inputted from the film scanner 12, the image processing section 38 determines that the event (7), namely, an error in reading, has occurred.

When it is determined that the event (6) or (7) has occurred, an operator is called by activating an alarm. Therefore, by continuing the state in which the above events have occurred, namely, the state in which images cannot be recorded, a decrease in the number of prints processed per unit time can be prevented.

An example, in which comparison of the output image data with the image data for recording, and comparison of the output image data for multiple output images with one another are carried out, has been described as an algorithm for checking the occurrence of the events (1) to (3). However, this algorithm is merely an example, and only one of these comparisons may be carried out.

Further, in place of the image data for recording, image data inputted from the film scanner 12, or image data obtained by subjecting image data to a predetermined processing (e.g., simple image processing such as conversion based on a lookup table or matrix calculation) may be used as image data used for comparison with the output image data. Particularly, defects, which have been formed at a part or all of the output image due to blockage in the ejection orifice of the nozzle of the recording head 46, can be accurately detected by using the above image data as well.

When the original image is a film image recorded on the photographic film 24 in 135 magazines, whether the recording format of the film image as the original image is a 135-size standard format or a panorama-size format can be easily detected by using the above-described image data. Therefore, by comparing the output image data with the above-described image data, it is possible to detect an inappropriate image processing carried out by the image processing device 14, such as erroneously detecting the recording format of a film image as the 135-size standard format and carrying out an image processing for the 135-size standard format, in spite of the fact that the recording format of the film image is the panorama-size format.

Further, the so-called linear recording head 46, which has multiple nozzles arranged over the entire width of the recording material 62, is used as an example of the recording head relating to the present invention, and a method, in which an image is recorded line by line by the recording head 46 while the recording material 62 is conveyed at a constant speed, has been described above. However, the recording head and the method are not limited to the above-described recording head and method. For example, a method in which an image is recorded on the recording material by moving the recording head (for scanning) in two directions intersecting each other (i.e., in a main-scan direction and a sub-scan direction), or a method in which an image is recorded on the recording material 62 by moving the recording head in a direction intersecting the direction in which the recording material 62 is conveyed, while the recording material 62 is conveyed at a constant speed, may be used.

Further, the second cutter 58, which includes the cutter mechanisms 92A and 92B each including the rotary blade 94 and the pulley 96, has been described above as the second cutting means. However, the number of the cutter mechanisms is not limited to two. Moreover, the structure of the respective cutter mechanisms are not limited to the structure described above, and various types of known cutter mechanisms can be used. Further, the recording formats described above are merely examples, and any recording format can be used.

As described above, in the present invention, the recording means can record images in parallel with each other along a transverse direction of the recording material by adhering ink droplets for recording, which have been ejected through ejection orifices of a recording head, to an elongated recording material. The recording material, on which images have been recorded by the recording means, is cut into pieces along boundaries of the recorded images, which boundaries extend in the transverse direction of the recording material. The pieces of the recording material are conveyed in a direction substantially orthogonal to the direction in which the pieces are cut by the first cutting means. The second cutting means is controlled so as to cut, from among the pieces of the recording material conveyed by the conveyance means, the piece of the recording material, on which the images are recorded, along boundaries of the respective recorded images, which boundaries extend in the direction in which the pieces are conveyed. Therefore, the present invention has an effect in that the processing time for a single image can be reduced.

Further, a cutter can be disposed at each position corresponding to one of the boundaries of the recorded images in the multiple types of recording formats, and can select whether or not to cut the pieces of the recording material. The recording format is determined for each of the pieces, and whether or not the recording material is to be cut by the respective cutters is selected. Thus, in addition to the effect described above, the apparatus can have a simple structure even if it can record images in the multiple recording formats.

The cutter has a disc-shaped member rotatably supported by a shaft, and a blade is formed around the periphery of the member. The cutter can be formed so as to be movable between a first position, at which the blade is pressed against the recording material and rotated along with the conveyance of the recording material, and a second position, at which the blade is spaced from the recording material. In this case, the structure of the apparatus can further be simplified even if the apparatus can record images in the multiple recording formats.

In the image recording apparatus of the present invention, the conveyance path may be controlled so that the piece of the recording material having multiple images recorded thereon, is conveyed along the first conveyance path, at which the second cutting means is disposed, and the piece having a single image recorded thereon is conveyed along the second conveyance path, at which no second cutting means is disposed. The present invention has an effect in that it is not necessary to change the cutting position with respect to the pieces of the recording material in accordance with the recording format, when only one recording format is used to record images on the recording material along the transverse direction thereof.

Moreover, work of an operator can be reduced if the present invention further includes the accumulating means for sorting and accumulating, for each photographic film or each order, the recording material that has been cut for each of the recorded images.

Further, the image recording apparatus of the present invention may include a means for forming a transparent film on the image recording surface of the recording material, on which surface an image has been recorded by the recording means. As a result, water resistance and weather resistance of the image, which has been recorded on the recording material, can be improved.

The transparent film may also be formed by attaching a transparent polymer film to the image recording surface. As a result, the transparent film can be formed stably and relatively inexpensively.

The image recording apparatus of the present invention may also include a heating means, which applies heat to the recording material on which images have been recorded, thereby removing a solvent included in the ink droplets adhered to the recording material. With the heating means, deterioration of the image quality of the recording material can be prevented.

The recording material may be shaped into a roll, and pulled out and conveyed to a recording position when images are to be recorded on the recording material. In this way, handling characteristics of the recording material during loading thereof in the image recording apparatus is improved.

The image recording apparatus may have a structure in which whether an event interfering with image recording carried out by the recording means has occurred during recording of images on the recording material by the image recording apparatus is monitored, and, when it is determined that the event has occurred, a processing for removing a defect, which has been caused by the event, is carried out. With this structure, the processing capability of the image recording apparatus and the yield of appropriate images can be increased.

What is claimed is:

1. An image recording apparatus for recording images represented by image data on an elongated recording material using ink, said image recording apparatus comprising:

recording means which includes a recording head, that has at least one ejection orifice and ejects ink droplets for recording from the ejection orifice so that the ink droplets adhere to the recording material, the recording means being able to record a plurality of images in parallel with each other along a transverse direction of the recording material;

first cutting means which cuts the recording material, after images have been recorded thereon, into pieces along boundaries of the recorded images, the boundaries extending in the transverse direction of the recording material;

conveyance means for conveying the pieces of the recording material, which pieces have been cut by the first cutting means, in a direction substantially orthogonal to a direction in which the pieces have been cut by the first cutting means;

second cutting means for cutting the pieces of the recording material, which pieces have been conveyed by the conveyance means, along boundaries of the recorded images, the boundaries extending in the direction in which the pieces are conveyed; and control means for controlling the second cutting means so that the second cutting means cuts the pieces, each having a plurality of images recorded thereon, along the boundaries of the respective recorded images, the boundaries extending in the direction in which the pieces are conveyed;

wherein the conveyance means conveys the pieces of the recording material along a conveyance path, which includes a first conveyance path, at which the second cutting means is disposed, and a second conveyance path at which no second cutting means is disposed.

2. The image recording apparatus of claim 1, wherein the recording means can record images in multiple recording formats having different boundaries for the respective images, the boundaries extending in the direction in which the pieces of the recording material are conveyed.

3. The image recording apparatus of claim 2, wherein the second cutting means is disposed at each of positions corresponding to the boundaries of the recorded images in the multiple recording formats.

4. The image recording apparatus of claim 3, wherein the second cutting means includes a cutter for cutting the pieces of the recording material and can select whether or not to cut the recording material.

5. The image recording apparatus of claim 4, wherein the control means determines the recording format for each of the pieces and controls selection of whether or not the second cutting means should cut the recording material.

6. The image recording apparatus of claim 5, wherein the cutter includes a shaft and a disc-shaped member rotatably supported by the shaft, the periphery of the member comprising a blade, and the cutter being able to move between a first position at which the blade is pressed against the recording material and rotated along with the conveyance of the recording material, and a second position at which the blade is spaced from the recording material.

7. The image recording apparatus of claim 1, further comprising a conveyance control means, which controls the conveyance means to switch the conveyance path for the pieces of the recording material to one of the first conveyance path and the second conveyance path, the conveyance control means controlling the conveyance means such that the pieces of the recording material which each have a plurality of images recorded thereon are conveyed along the first conveyance path, and the pieces which each have a single image recorded thereon are conveyed along the second conveyance path.

8. The image recording apparatus of claim 1, further comprising accumulating means for sorting and accumulating the recording material, which has been cut for each of the recorded images by the second cutting means.

9. The image recording apparatus of claim 1, further comprising film forming means for forming a transparent film on an image recording surface of the recording material, on which surface an image has been recorded by the recording means.

10. The image recording apparatus of claim 9, wherein the film forming means forms the transparent film by attaching a transparent polymer film to the image recording surface.

11. The image recording apparatus of claim 1, further comprising heating means, which applies heat energy to the recording material on which images have been recorded by the recording means, thereby removing a solvent included in the ink droplets for recording and adhering to the recording material.

12. The image recording apparatus of claim 1, wherein the recording material is provided in a roll, further comprising supply means for supplying the recording material, which supply means unwinds the recording material from the roll thereof and conveys the recording material to a position at which an image is recorded by the recording means.

13. The image recording apparatus of claim 1, further comprising:

monitoring means for monitoring whether an event, which interferes with image recording carried out by the recording means, has occurred during recording by the image recording apparatus; and processing means which, when the monitoring means determines that the event has occurred, carries out processing for removing a defect caused by the event.

14. The image recording apparatus of claim 13, wherein the monitoring means includes image reading means for reading an output image, which has been recorded on the recording material by the recording means, and determines whether the event has occurred based on the results of comparison of output image data obtained by the image reading means with the image data for recording.

* * * * *